US007958812B2

(12) United States Patent
Wang et al.

(10) Patent No.: US 7,958,812 B2
(45) Date of Patent: Jun. 14, 2011

(54) FLEXIBLE SPIKE AND BALLISTIC RESISTANT PANEL

(75) Inventors: Yunzhang Wang, Duncan, SC (US); Thomas Mabe, Spartanburg, SC (US)

(73) Assignee: Milliken & Company, Spartanburg, SC (US)

( * ) Notice: Subject to any disclaimer, the term of this patent is extended or adjusted under 35 U.S.C. 154(b) by 320 days.

(21) Appl. No.: 12/291,450

(22) Filed: Nov. 10, 2008

(65) Prior Publication Data

US 2011/0005379 A1 Jan. 13, 2011

(51) Int. Cl.
*F41H 5/02* (2006.01)

(52) U.S. Cl. ..... 89/36.02; 89/36.05; 89/922; 428/911; 2/2.5

(58) Field of Classification Search ..... 89/36.02, 89/36.05; 428/911; 109/49.5; 2/2.5
See application file for complete search history.

(56) References Cited

U.S. PATENT DOCUMENTS

| | | | | |
|---|---|---|---|---|
| 1,213,118 | A * | 1/1917 | Lynch | 428/74 |
| 3,563,836 | A * | 2/1971 | Dunbar | 428/44 |
| 3,601,923 | A | 8/1971 | Rosenberg | |
| 4,186,648 | A | 2/1980 | Clausen et al. | |
| 4,292,882 | A | 10/1981 | Clausen | |
| 4,425,080 | A | 1/1984 | Stanton et al. | |
| 4,623,574 | A | 11/1986 | Harpell et al. | |
| 4,690,825 | A | 9/1987 | Won | |
| 4,879,165 | A | 11/1989 | Smith | |
| 4,961,685 | A | 10/1990 | Neubert | |
| 4,969,386 | A | 11/1990 | Sandstrom et al. | |
| 5,011,183 | A | 4/1991 | Thornton et al. | |
| 5,035,111 | A | 7/1991 | Hogenboom et al. | |
| 5,045,371 | A | 9/1991 | Calkins | |
| 5,110,661 | A | 5/1992 | Groves | |
| 5,145,675 | A | 9/1992 | Won | |
| 5,225,241 | A | 7/1993 | Dischler | |
| 5,275,873 | A | 1/1994 | Chitrangad | |
| 5,322,721 | A | 6/1994 | McGinnis, Jr. et al. | |
| 5,402,703 | A | 4/1995 | Drotleff | |
| 5,466,503 | A | 11/1995 | Dischler | |

(Continued)

FOREIGN PATENT DOCUMENTS

GB 2 242 193 9/1991

(Continued)

*Primary Examiner* — Bret Hayes
*Assistant Examiner* — Michael D David
(74) *Attorney, Agent, or Firm* — Cheryl J. Brickey

(57) ABSTRACT

A flexible spike and ballistics panel having a strike surface and a rear surface. The panel contains a strike face grouping and a rear face grouping, where the normalized stiffness of each strike face layer is about 3 to 50 times greater than the normalized stiffness of each textile layer. The strike face grouping contains at least two strike face layers, each strike face layer having resin and high tenacity yarns, where the high tenacity yarns are in an amount of at least 50% by weight in each layer, where the high tenacity yarns have a tenacity of at least 5 grams per denier, and where the strike face grouping forms the strike surface of the panel. The rear face grouping contains at least ten layers of a spike resistant textile layer, each textile layer having a plurality of interwoven yarns or fibers having a tenacity of about 5 or more grams per denier, where at least one of the surfaces of the spike resistant textile layer contains about 10 wt. % or less, based on the total weight of the textile layer, of a coating comprising a plurality of particles having a diameter of about 20 μm or less.

18 Claims, 4 Drawing Sheets

U.S. PATENT DOCUMENTS

| | | | | |
|---|---|---|---|---|
| 5,533,755 | A | 7/1996 | Nelsen et al. | |
| 5,569,509 | A | 10/1996 | Dischler | |
| 5,580,629 | A | 12/1996 | Dischler | |
| 5,589,254 | A | 12/1996 | Dischler | |
| 5,595,809 | A | 1/1997 | Dischler | |
| 5,776,839 | A | 7/1998 | Dischler et al. | |
| 5,880,042 | A | 3/1999 | Schuster et al. | |
| 6,248,676 | B1 | 6/2001 | Dischler | |
| 6,475,936 | B1 | 11/2002 | Chiou | |
| 6,543,055 | B2 | 4/2003 | Howland et al. | |
| 6,656,570 | B1 | 12/2003 | Fels et al. | |
| 6,737,368 | B2 | 5/2004 | Chiou | |
| 6,846,548 | B2 | 1/2005 | Harpell et al. | |
| 6,893,989 | B2 | 5/2005 | Breukers | |
| 7,241,709 | B2 * | 7/2007 | Chiou et al. | 442/246 |
| 7,393,588 | B1 * | 7/2008 | Howland | 428/415 |
| 7,642,206 | B1 * | 1/2010 | Bhatnagar et al. | 442/135 |
| 7,825,048 | B2 * | 11/2010 | Wang et al. | 442/135 |
| 2002/0106957 | A1 | 8/2002 | Ritter | |
| 2004/0048109 | A1 | 3/2004 | Granqvist et al. | |
| 2004/0048538 | A1 | 3/2004 | Granqvist et al. | |
| 2005/0003727 | A1 | 1/2005 | Chiou | |
| 2005/0266748 | A1 | 12/2005 | Wagner et al. | |
| 2007/0071960 | A1 | 3/2007 | Eleazer et al. | |
| 2007/0105471 | A1 | 5/2007 | Wang et al. | |
| 2009/0311930 | A1 * | 12/2009 | Wang et al. | 442/134 |

FOREIGN PATENT DOCUMENTS

| | | |
|---|---|---|
| WO | 2006/121411 | 11/2006 |

* cited by examiner

*FIG. –1–*

FLEXIBLE SPIKE AND BALLISTIC RESISTANT PANEL

FIELD OF THE INVENTION

The present application is directed to flexible panels exhibiting spike and ballistic resistant properties.

BACKGROUND

Police, correctional officers, security personnel, and even private individuals have a growing need for simultaneous protection from multiple types of penetration threats, including spike, knife and ballistic threats, in a single protective garment. Known materials that protect against knife threats typically have flexible metallic plates, metallic chain mails, or laminated, resinated, or coated fabrics. However, the flexible metallic components tend to increase the weight of vests and are difficult to be cut into irregular shapes to fit the body. Further, materials with laminated or resinated or coated fabrics are less satisfactory against knife and spike stab.

Further, merely combining separate materials, each known to protect against one threat, with other material(s) known to protect against other threat(s) does not usually provide a flexible light weight structure comfortable for body wear with adequate protection against multiple threats. Thus, there is a need for a flexible light weight structure that resists penetration by multiple threats. While in Europe knife and spike threats are of major concern, in the United States ballistics and spike threats are of more interest. It is a primary object to provide a flexible light weight structure that resists penetration by ballistic and spike-like threats.

BRIEF SUMMARY OF THE INVENTION

The invention provides a light weight flexible spike and ballistics panel having a strike surface and a rear surface. The panel contains a strike face grouping and a rear face grouping, where the normalized stiffness of each strike face layer is about 3 to 50 times greater than the normalized stiffness of each rear face layer. The strike face grouping contains at least two strike face layers, each strike face layer having resin and high tenacity yarns, where the high tenacity yarns are in an amount of at least 50% by weight in each layer, where the high tenacity yarns have a tenacity of at least 5 grams per denier, and where the strike face grouping forms the strike surface of the panel. The rear face grouping contains at least ten layers of a spike resistant textile layer, each textile layer having a plurality of interwoven yarns or fibers having a tenacity of about 5 or more grams per denier, where at least one of the surfaces of the spike resistant textile layer contains about 10 wt. % or less, based on the total weight of the textile layer, of a coating comprising a plurality of particles having a diameter of about 20 μm or less.

The flexible spike and ballistics panel according to the invention can further comprise ballistic resistant materials and/or additional puncture resistant materials (e.g., chain mail, metal plating, or ceramic plating). The invention also provides a process for producing a flexible spike and ballistics panel.

DETAILED DESCRIPTION OF THE INVENTION

The invention is directed to a flexible spike and ballistic resistant panel. As utilized herein, the term "spike resistant" is generally used to refer to a material that provides protection against penetration of the material by sharp-pointed weapons or objects, such as an ice pick. Thus, a "spike resistant" material can either prevent penetration of the material by such an object or can lessen the degree of penetration of such an object as compared to similar, non-spike resistant materials. As utilized herein, the term "knife resistant" is generally used to refer to a material that provides protection against penetration of the material by edged blades such as knives and other knife-like weapons or objects. Thus, a "knife resistant" material can either prevent penetration of the material by such an object or can lessen the degree of penetration of such an object as compared to similar, non-knife resistant materials.

Preferably, a "spike resistant" material achieves a pass rating when tested against Level 1, Spike class threats in accordance with National Institute of Justice (NIJ) Standard 0115.00 (2000), entitled "Stab Resistance of Personal Body Armor." The term "spike resistant" can also refer to materials (e.g., a composite according to the invention) achieving a pass rating when tested against higher level threats (e.g., Level 2 or Level 3). Preferably, a "knife resistant" material achieves a pass rating when tested against Level 1, edged blade class threats in accordance with National Institute of Justice (NIJ) Standard 0115.00 (2000), entitled "Stab Resistance of Personal Body Armor." The term "knife resistant" can also refer to materials (e.g., a composite according to the invention) achieving a pass rating when tested against higher level threats (e.g., Level 2 or Level 3).

In certain possibly preferred embodiments, the invention can also be directed to spike, knife and ballistic resistant flexible panels. As utilized herein, the term "ballistic resistant" generally refers to a material that is resistant to penetration by ballistic projectiles. Thus, a "ballistic resistant" material can either prevent penetration of the material by a ballistic projectile or can lessen the degree of penetration of such ballistic projectiles as compared to similar, non-ballistic resistant materials. Preferably, a "ballistic resistant" material provides protection equivalent to Type I body armor when such material is tested in accordance with National Institute of Justice (NIJ) Standard 0101.04 (2000), entitled "Ballistic Resistance of Personal Body Armor." The term "ballistic resistant" also refers to a material that achieves a pass rating when tested against Level 1 or higher (e.g., Level 2A, Level 2, Level 3A, or Level 3 or higher) ballistic threats in accordance with NIJ Standard 0101.04.

Figure 1:
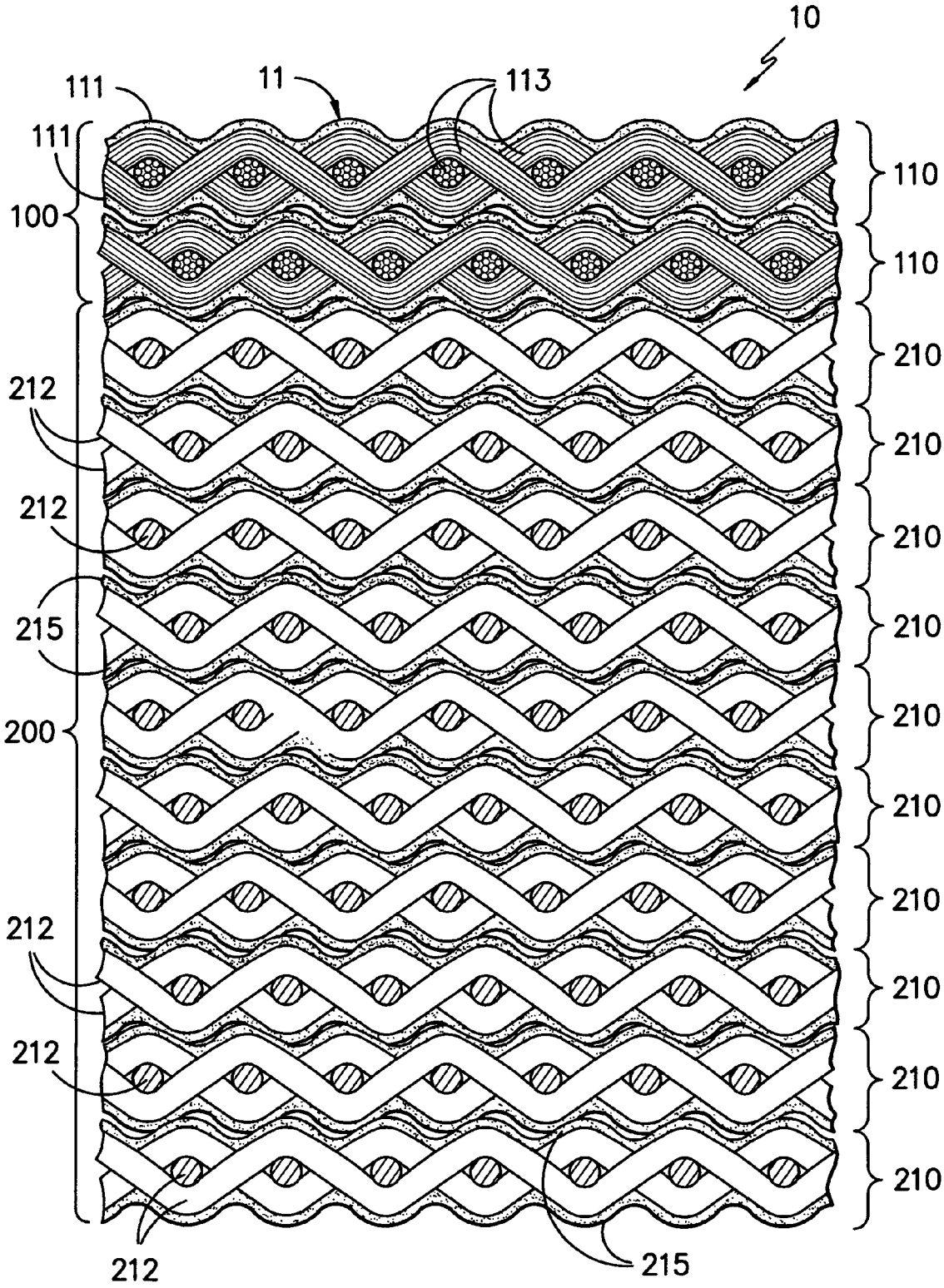
FIG. 1 is a sectional view of a flexible spike and ballistic resistant panel according to the invention.

Referring now to FIG. 1, the flexible spike and ballistics panel 10 contains a strike face grouping 100 and a rear face grouping 200. The strike face grouping 100 contains at least 2 strike face layers 110, which contain resin and high tenacity yarns. The outer surface of the strike face grouping 100 forms the strike surface 11 for the panel 10. The rear face grouping 200 contains at least 10 spike resistant textile layers 210, each layer 210 containing a plurality of interwoven yarns or fibers having a tenacity of about 5 or more grams per denier, at least one of the surfaces of the spike resistant textile layers comprising about 10 wt. % or less, based on the total weight of the textile layer, of a coating comprising a plurality of particles having a diameter of about 20 μm or less. The normalized stiffness of each strike face layer 110 is about 3 to 50 times greater than the normalized stiffness of each textile layer 210. More preferably the normalized stiffness of each strike face layer 110 is about 5 to 30 times greater than the normalized stiffness of each textile layer 210. Normalized stiffness is tested using a modified ASTM Test Method D6828-02.

It has been found that the particle treated spike resistant textile layers 210 had significantly higher spike penetration resistance as compared to the same construction of textile layers without the particles. The key mechanism of improved spike penetration resistance of the treated fabric is believed to be inter-layer interactions. When the spike resistant textile layers 210 are combined with other materials such as the strike face layers (resin coated high tenacity yarns) to improve ballistic blunt trauma performance (to pass ballistic Level II and Spike Level 3 at weight less than 1.2 psf), the spike resistant performance changes significantly depending on the configurations. Because the strike face layers 110 are more rigid than the spike resistant textile layers 210, the intuitive configuration would be to put the strike face layers 110 in the back of the spike resistant textile layers 210 to reduce blunt trauma. However, this configuration reduces the spike penetration resistant performance significantly. It was discovered that when the configuration is reversed by placing the strike face layers 110 as the strike face, in front of the spike resistant textile layers 210, the spike penetration performance is much improved without significantly reducing the blunt trauma performance.

The flexible spike and ballistic panel 10 is flexible, where flexible is defined to be able to be bent to a radius of one foot or less without effecting performance. In one embodiment, the panel 10 is greater than about 80% by weight spike resistant textile layers and less than about 20% by weight strike face layers. More preferably, the panel 10 is greater than about 85% by weight spike resistant textile layers and less than about 15% by weight strike face layers.

While the flexible panel 10 has been depicted in FIG. 1 as including two (2) strike face layers, those of ordinary skill in the art will readily appreciate that the flexible panel 10 can comprise any suitable number of strike face layers 110. For example, the flexible panel 10 can comprise three strike face layers, four strike face layers, ten strike face layers, or more. While the flexible panel 10 has been depicted in FIG. 1 as including ten textile layers 210, those of ordinary skill in the art will readily appreciate that the flexible panel 10 can comprise any suitable number of textile layers 210, for example, twelve layers, eighteen layers, twenty layers, thirty layers, forty layers, or more.

Figure 2:
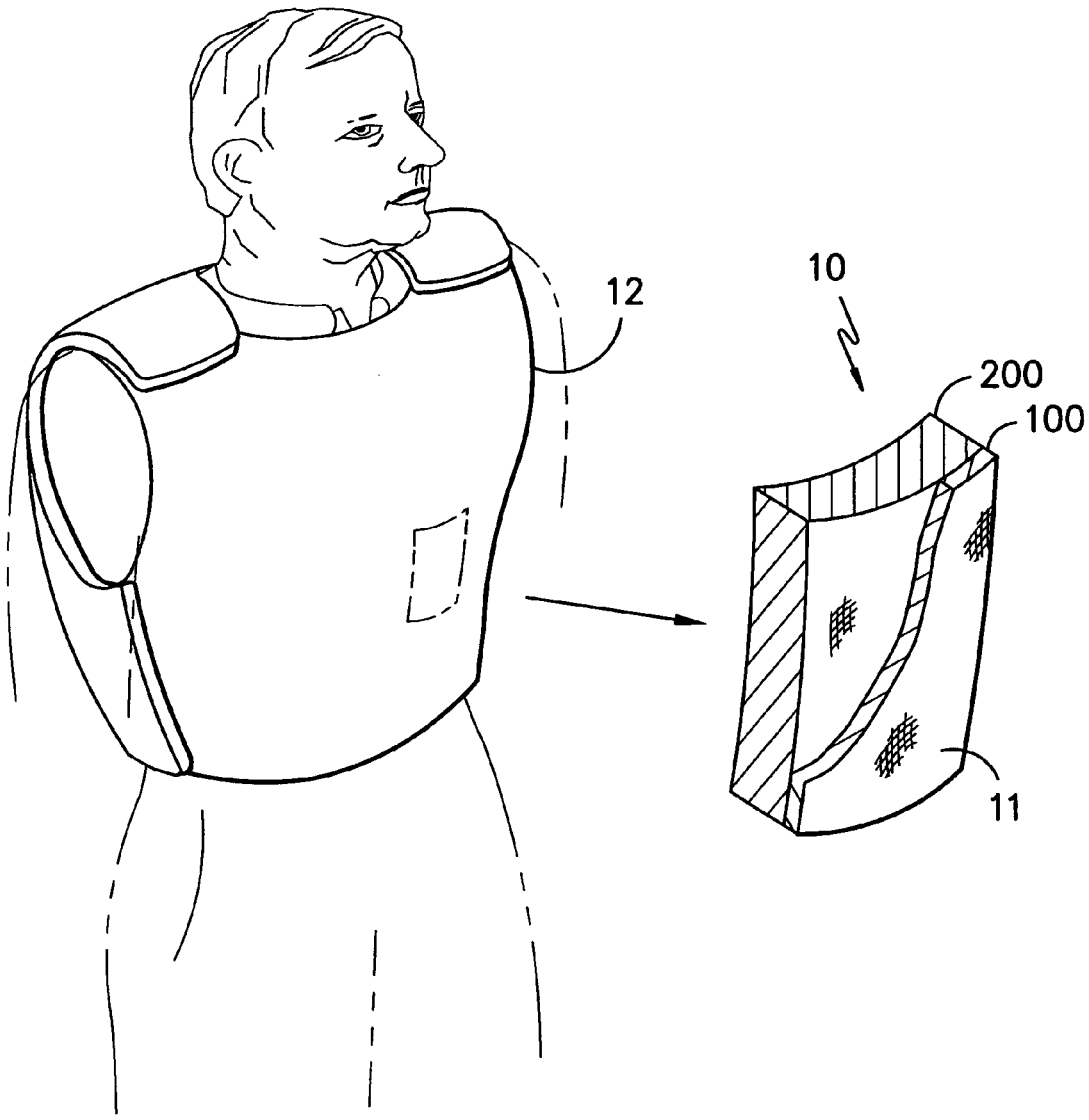
FIG. 2 is a perspective view of a personal protection device, specifically a vest, incorporating the flexible spike and ballistic resistant panel of the invention.

The flexible spike and ballistic resistant panel 10 of the invention is particularly well suited for use in personal protection devices, such as personal body armor. For example, as depicted in FIG. 2, the flexible spike and ballistic resistant panel 10 can be incorporated into a vest 12 in order to provide the wearer protection against spike, ballistic, and in certain embodiments knife threats.

The rear face grouping 200 contains at least ten (10) spike resistant textile layers 210, more preferably twenty (20) layers. While the spike resistant textile layer 210 is described as being spike resistant, the textile layer 210 may also have knife and/or ballistic resistant properties. Each spike resistant textile layer 210 contains a plurality of interlocking yarns or fibers 212 having a tenacity of about 5 or more grams per denier, more preferably about 8 or more, more preferably about 10 or more, more preferably about 15 or more. In a preferred embodiment, the plurality of yarns or fibers 212 have a tenacity of about 10 or more grams per denier and have a size of less than ten denier per filament, more preferably less than 5 denier per filament. The spike resistant textile layers 212 can have any suitable weight. In certain possibly preferred embodiments, the spike resistant textile layers 212 can have a weight of about 2 to about 10 ounces per square yard.

The spike resistant textile layers 210 can have any suitable construction. The spike resistant textile layers 210 can comprise a plurality of yarns provided in a knit or woven construction. The construction of the textile layers 210 resists slippage of the fibers or yarns past one another. Alternatively, the spike resistant textile layers 210 can comprise a plurality of fibers provided in a suitable nonwoven construction (e.g., a needle-punched nonwoven, etc).

For the embodiment where the spike resistant textile layers are in a woven construction, the woven layer preferably includes a multiplicity of warp and weft elements interwoven together such that a given weft element extends in a predefined crossing pattern above and below the warp element. One preferred weave is the plain weave where each weft element passes over a warp element and thereafter passes under the adjacent warp element in a repeating manner across the full width of the textile layer. Thus, the terms "woven" and "interwoven" are meant to include any construction incorporating interengaging formation fibers or yarns.

As will be understood by those of ordinary skill in the art, the rear face grouping 200 in the flexible panel 10 can be independently provided in each of the aforementioned suitable constructions. For example, the rear face grouping 200 may have five (5) spike resistant textile layers 210 in a knit construction and five (5) spike resistant textile layers 210 in a woven construction. The different constructions may be grouped together, arranged in a repeating pattern or arranged randomly. In certain possibly preferred embodiments, the spike resistant textile layers 210 comprise a plurality of yarns 212 provided in a woven construction.

In one embodiment, the spike resistance textile layers 210 have a tightness factor of greater than about 0.75 as defined in U.S. Pat. No. 6,133,169 (Chiou) and U.S. Pat. No. 6,103,646 (Chiou), which are incorporated herein by reference. "Fabric tightness factor" and "Cover factor" are names given to the density of the weave of a fabric. Cover factor is a calculated value relating to the geometry of the weave and indicating the percentage of the gross surface area of a fabric that is covered by yarns of the fabric. The equation used to calculate cover factor is as follows (from Weaving: Conversion of Yarns to Fabric, Lord and Mohamed, published by Merrow (1982), pages 141-143):

$d_w$=width of warp yarn in the fabric
$d_f$=width of fill yarn in the fabric
$p_w$=pitch of warp yarns (ends per unit length)
$p_f$=pitch of fill yarns $$C_w = \frac{d_w}{p_w} C_f = \frac{d_f}{p_f}$$

$$\text{Fabric_Cover_Factor} = Cfab = \frac{\text{total_area_obsured}}{\text{area_enclosed}}$$

$$C_{fab} = \frac{(p_w - d_w)d_f + d_w p_f}{p_w p_f}$$

$$C_{fab} = (C_f + C_w - C_f C_w)$$

Depending on the kind of weave of a fabric, the maximum cover factor may be quite low even though the yarns of the fabric are situated close together. For that reason, a more useful indicator of weave tightness is called the "fabric tightness factor". The fabric tightness factor is a measure of the tightness of a fabric weave compared with the maximum weave tightness as a function of the cover factor.

$$\text{Fabric_tightness_factor} = \frac{\text{actual_cover_factor}}{\text{maximum_cover_factor}}$$

For example, the maximum cover factor that is possible for a plain weave fabric is 0.75; and a plain weave fabric with an actual cover factor of 0.68 will, therefore, have a fabric tightness factor of 0.91. The preferred weave for practice of this invention is plain weave.

The yarns or fibers 212 of the spike resistant textile layers 210 can comprise any suitable fibers. Yarns or fibers 212 suitable for use in the spike resistant textile layer 210 generally include, but are not limited to, high tenacity and high modulus yarns or fibers, which refers to yarns that exhibit a relatively high ratio of stress to strain when placed under tension. In order to provide adequate protection against ballistic projectiles, the yarns or fibers of the spike resistant textile layers 210 typically have a tenacity of about 8 or more grams per denier. In certain possibly preferred embodiments, the yarns or fibers of the spike resistant textile layers 210 can have a tenacity of about 10 or more grams per denier, more preferably 15 or more grams per denier.

Figure 3A:
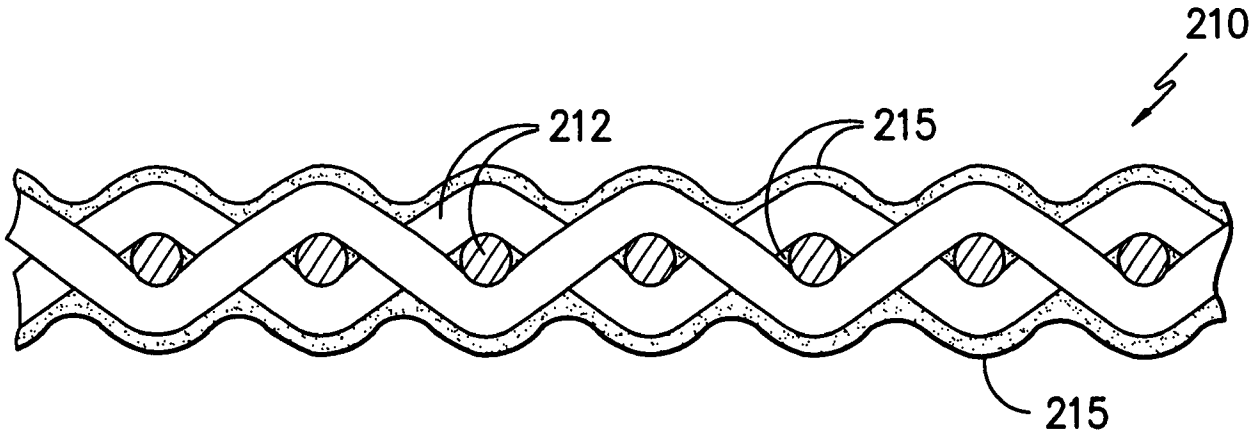
FIGS. 3A, 3B, and 3C illustrate schematically cross-section of different embodiments of the spike resistant textile layers.
Figure 3B:
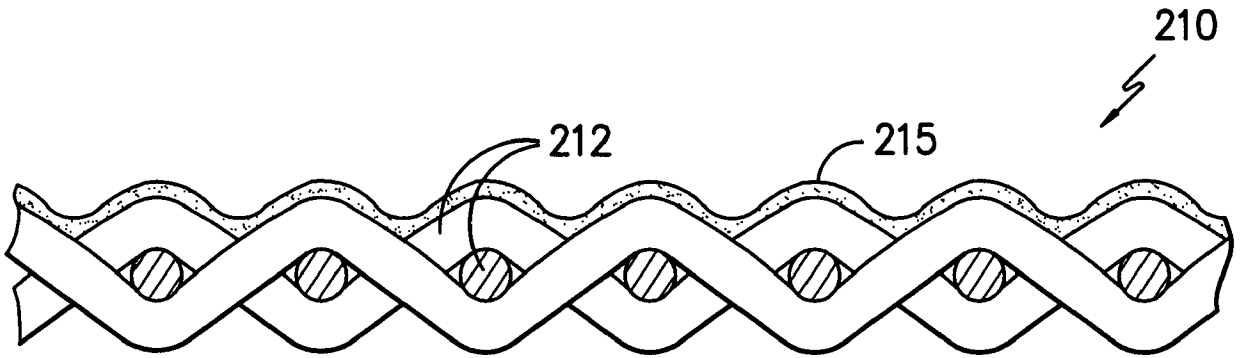
Figure 3C:
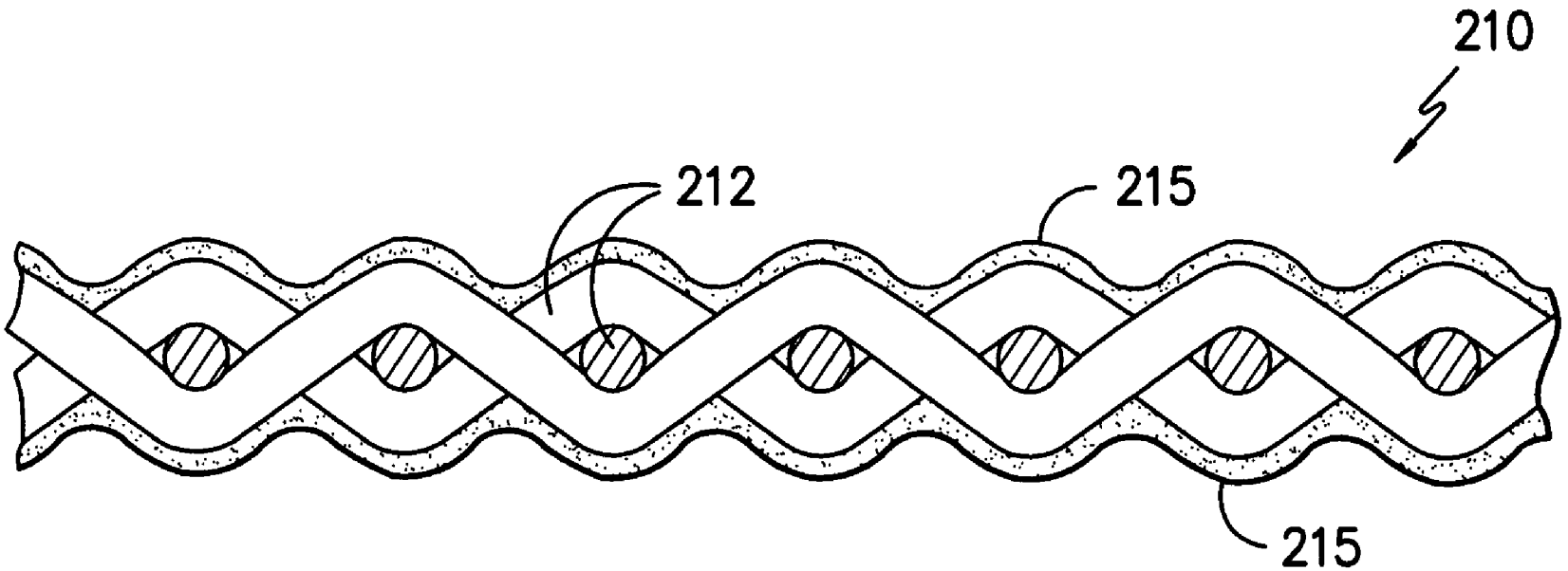

The spike resistant textile layer 210 comprises a coating 215 on at least a surface thereof in a weight of about 10 wt. % or less, based on the total weight of the textile layer, of a coating comprising a plurality of particles having a diameter of about 20 μm or less. In certain possibly preferred embodiments, the coating can penetrate into the interior portion of the textile layer 210 to at least partially coat the yarns or fibers 212 of the spike resistant textile layer 210. FIG. 3A shows a spike resistant textile layer 210 with the coating 215 on both sides and in the interior of the fibers 212. FIG. 3B shows a spike resistant textile layer 210 with the coating 215 applied to one surface of the spike resistant textile layer 210. FIG. 3C shows a spike resistant textile layer 210 with the coating 215 on both sides of the fibers 212.

The coating 215 applied to the spike resistant textile layers 210 comprises particulate matter (e.g., a plurality of particles). The particles included in the coating 215 can be any suitable particles, but preferably are particles having a diameter of about 20 μm or less, or about 10 μm or less, or about 1 μm or less (e.g., about 500 nm or less or about 300 nm or less). Particles suitable for use in the coating include, but are not limited to, silica particles, (e.g., fumed silica particles, precipitated silica particles, alumina-modified colloidal silica particles, etc.), alumina particles (e.g. fumed alumina particles), and combinations thereof. In certain possibly preferred embodiments, the particles are comprised of at least one material selected from the group consisting of fumed silica, precipitated silica, fumed alumina, alumina modified silica, zirconia, titania, silicon carbide, titanium carbide, tungsten carbide, titanium nitride, silicon nitride, and the like, and combinations thereof. Such particles can also be surface modified, for instance by grafting, to change surface properties such as charge and hydrophobicity. Suitable commercially available particles include, but are not limited to, the following: CAB-O-SPERSE® PG003 fumed alumina, which is a 40% by weight solids aqueous dispersion of fumed alumina available commercially from Cabot Corporation of Boyertown, Pa. (the dispersion has a pH of 4.2 and a median average aggregate particle size of about 150 nm); SPECTRAL™ 51 fumed alumina, which is a fumed alumina powder available commercially from Cabot Corporation of Boyertown, Pa. (the powder has a BET surface area of 55 $m^2/g$ and a median average aggregate particle size of about 150 nm); CAB-O-SPERSE® PG008 fumed alumina, which is a 40% by weight solids aqueous dispersion of fumed alumina available commercially from Cabot Corporation of Boyertown, Pa. (the dispersion has a pH of 4.2 and a median average aggregate particle size of about 130 nm); SPECTRAL™ 81 fumed alumina, which is a fumed alumina powder available commercially from Cabot Corporation of Boyertown, Pa. (the powder has a BET surface area of 80 $m^2/g$ and a median average aggregate particle size of about 130 nm); AEROXIDE ALU C fumed alumina, which is a fumed alumina powder available commercially from Degussa, Germany (the powder has a BET surface area of 100 $m^2/g$ and a median average primary particle size of about 13 nm); LUDOX® CL-P colloidal alumina coated silica, which is a 40% by weight solids aqueous sol available from Grace Davison (the sol has a pH of 4 and an average particle size of 22 nm in diameter); NALCO® 1056 aluminized silica, which is a 30% by weight solids aqueous colloidal suspension of aluminized silica particles (26% silica and 4% alumina) available commercially from Nalco; LUDOX® TMA colloidal silica, which is a 34% by weight solids aqueous colloidal silica sol available from Grace Davison. (the sol has a pH of 4.7 and an average particle size of 22 nm in diameter); NALCO® 88SN-126 colloidal titanium dioxide, which is a 10% by weight solids aqueous dispersion of titanium dioxide available commercially from Nalco; CAB-O-SPERSE® S3295 fumed silica, which is a 15% by weight solids aqueous dispersion of fumed silica available commercially from Cabot Corporation of Boyertown, Pa. (the dispersion has a pH of 9.5 and an average agglomerated primary particle size of about 100 nm in diameter); CAB-O-SPERSE® 2012A fumed silica, which is a 12% by weight solids aqueous dispersion of fumed silica available commercially from Cabot Corporation of Boyertown, Pa. (the dispersion has a pH of 5); CAB-O-SPERSE® PG001 fumed silica, which is a 30% by weight solids aqueous dispersion of fumed silica available commercially from Cabot Corporation of Boyertown, Pa. (the dispersion has a pH of 10.2 and a median aggregate particle size of about 180 nm in diameter); CAB-O-SPERSE® PG002 fumed silica, which is a 20% by weight solids aqueous dispersion of fumed silica available commercially from Cabot Corporation of Boyertown, Pa. (the dispersion has a pH of 9.2 and a median aggregate particle size of about 150 nm in diameter); CAB-O-SPERSE® PG022 fumed silica, which is a 20% by weight solids aqueous dispersion of fumed silica available commercially from Cabot Corporation of Boyertown, Pa. (the dispersion has a pH of 3.8 and a median aggregate particle size of about 150 nm in diameter); SIPERNAT® 22LS precipitated silica, which is a precipitated silica powder available from Degussa of Germany (the powder has a BET surface area of 175 $m^2/g$ and a median average primary particle size of about 3 μm); SIPERNAT® 500LS precipitated silica, which is a precipitated silica powder available from Degussa of Germany (the powder has a BET surface area of 450 $m^2/g$ and a median average primary particle size of about 4.5 μm); and VP Zirconium Oxide fumed zirconia, which is a fumed zirconia powder available from Degussa of Germany (the powder has a BET surface area of 60 $m^2/g$).

In certain possibly preferred embodiments, the particles can have a positive surface charge when suspended in an aqueous medium, such as an aqueous medium having a pH of about 4 to 8. Particles suitable for use in this embodiment include, but are not limited to, alumina-modified colloidal silica particles, alumina particles (e.g. fumed alumina particles), and combinations thereof. In certain possibly preferred embodiments, the particles can have a Mohs' hardness of about 5 or more, or about 6 or more, or about 7 or more. Particles suitable for use in this embodiment include, but are not limited to, fumed alumina particles. In certain possibly preferred embodiments, the particles can have a three-dimensional branched or chain-like structure comprising or consisting of aggregates of primary particles. Particles suitable for use in this embodiment include, but are not limited to, fumed alumina particles, fumed silica particles, and combinations thereof.

The particles included in the coating can be modified to impart or increase the hydrophobicity of the particles. For example, in those embodiments comprising fumed silica particles, the fumed silica particles can be treated, for example, with an organosilane in order to render the fumed silica particles hydrophobic. Suitable commercially-available hydrophobic particles include, but are not limited to, the R-series of AEROSIL® fumed silicas available from Degussa, such as AEROSIL® R812, AEROSIL® R816, AEROSIL® R972, and AEROSIL® R7200. While not wishing to be bound to any particular theory, it is believed that using hydrophobic particles in the coating will minimize the amount of water that the layers and panel will absorb when exposed to a wet environment. When hydrophobic particles are utilized in the coating on the textile layers 210, the hydrophobic particles can be applied using a solvent-containing coating composition in order to assist their application. Such particles and coatings are believed to be more fully described in U.S. Patent Publication No. 2007/0105471 (Wang et al.), incorporated herein by reference.

The spike resistant textile layers 210 can comprise any suitable amount of the coating 215. As will be understood by those of ordinary skill in the art, the amount of coating applied to the spike resistant textile layers 210 generally should not be so high that the weight of the flexible panel 10 is dramatically increased, which could potentially impair certain end uses for the panel 10. Typically, the amount of coating 215 applied to the spike resistant textile layers 210 will comprise about 10 wt. % or less of the total weight of the textile layer 210. In certain possibly preferred embodiments, the amount of coating applied to the spike resistant textile layers 210 will comprise about 5 wt. % or less or about 3 wt. % or less (e.g., about 2 wt. % or less) of the total weight of the textile layer 210. Typically, the amount of coating applied to the spike resistant textile layers 210 will comprise about 0.1 wt. % or more (e.g., about 0.5 wt. % or more) of the total weight of the textile layer 210. In certain possibly preferred embodiments, the coating comprises about 2 to about 4 wt. % of the total weight of the textile layer 210.

In certain possibly preferred embodiments of the flexible spike and ballistic resistant panel 10, the coating 215 applied to the spike resistant textile layers 210 can further comprise a binder. The binder included in the coating 215 can be any suitable binder. Suitable binders include, but are not limited to, isocyanate binders (e.g., blocked isocyanate binders), acrylic binders (e.g, nonionic acrylic binders), polyurethane binders (e.g., aliphatic polyurethane binders and polyether based polyurethane binders), epoxy binders, and combinations thereof. In certain possibly preferred embodiments, the binder is a cross-linking binder, such as a blocked isocyanate binder.

When present, the binder can comprise any suitable amount of the coating applied to the spike resistant textile layers 210. The ratio of the amount (e.g., weight) of particles present in the coating to the amount (e.g., weight) of binder solids present in the coating 215 typically is greater than about 1:1 (weight particles:weight binder solids). In certain possibly preferred embodiments, the ratio of the amount (e.g., weight) of particles present in the coating 215 to the amount (e.g., weight) of binder solids present in the coating typically is greater than about 2:1, or greater than about 3:1, or greater than about 4:1, or greater than about 5:1 (e.g., greater than about 6:1, greater than about 7:1, or greater than about 8:1). It is noted that when the coating 215 is applied to the spike resistant layer, the spike layer can have a much lower fabric tightness fabric to achieve the same level of spike resistance.

In certain possibly preferred embodiments, the coating 215 applied to the spike resistant textile layers 210 can comprise a water-repellant in order to impart greater water repellency to the flexible panel 10. The water-repellant included in the coating can be any suitable water-repellant including, but not limited to, fluorochemicals or fluoropolymers.

Referring back to FIG. 1, the strike face group 100 contains at least 2 strike face layers 110. Each of these strike face layers 110 contain resin 111 and high tenacity yarns 113, where at least about 50% by weight of the strike face layer 110 are the high tenacity yarns 113. In order to provide adequate protection against ballistic projectiles and other threats, the yarns 113 of the strike face layers 110 have a tenacity of about 8 or more grams per denier. In certain possibly preferred embodiments, the yarns 113 can have a tenacity of about 10 or more grams per denier, more preferably 15 or more grams per denier. The strike face layers 110 can have any suitable construction. For example, the strike face layers 110 can comprise a high tenacity yarns 113 provided in a knit or woven construction. Alternatively, the strike face layers 110 can comprise a plurality of high tenacity yarns 113 provided in a suitable non-woven construction such as a needle-punched non-woven, an air-laid non-woven, a unidirectional layer etc. In one preferred embodiment, the strike face layers are in a woven construction.

For the embodiment where the strike face layers 110 are in a woven construction, the woven layer preferably includes a multiplicity of warp and weft elements interwoven together such that a given weft element extends in a predefined crossing pattern above and below the warp element. One preferred weave is the plain weave where each weft element passes over a warp element and thereafter passes under the adjacent warp element in a repeating manner across the full width of the textile layer. Thus, the terms "woven" and "interwoven" are meant to include any construction incorporating interengaging formation fibers or yarns.

For both the high tenacity yarns 113 of the strike face layers 110 and fibers or yarns interwoven in the spike resistant textile layers 210 a non-inclusive listing of suitable fibers and yarns include, fibers made from highly oriented polymers, such as gel-spun ultrahigh molecular weight polyethylene fibers (e.g., SPECTRA® fibers from Honeywell Advanced Fibers of Morristown, N.J. and DYNEEMA® fibers from DSM High Performance Fibers Co. of the Netherlands), melt-spun polyethylene fibers (e.g., CERTRAN® fibers from Celanese Fibers of Charlotte, N.C.), melt-spun nylon fibers (e.g., high tenacity type nylon 6,6 fibers from Invista of Wichita, Kans.), melt-spun polyester fibers (e.g., high tenacity type polyethylene terephthalate fibers from Invista of Wichita, Kans.), and sintered polyethylene fibers (e.g., TENSYLON® fibers from ITS of Charlotte, N.C.). Suitable fibers also include those made from rigid-rod polymers, such as lyotropic rigid-rod polymers, heterocyclic rigid-rod polymers, and thermotropic liquid-crystalline polymers. Suitable fibers made from lyotropic rigid-rod polymers include aramid fibers, such as poly(p-phenyleneterephthalamide) fibers (e.g., KEVLAR® fibers from DuPont of Wilmington, Del. and TWARON® fibers from Teijin of Japan) and fibers made from a 1:1 copolyterephthalamide of 3,4'-diaminodiphenylether and p-phenylenediamine (e.g., TECHNORA® fibers from Teijin of Japan). Suitable fibers made from heterocyclic rigid-rod polymers, such as p-phenylene heterocyclics, include poly(p-phenylene-2,6-benzobisoxazole) fibers (PBO fibers) (e.g., ZYLON® fibers from Toyobo of Japan), poly(p-phenylene-2,6-benzobisthiazole) fibers (PBZT fibers), and poly[2,6-diimidazo[4,5-b:4',5'-e]pyridinylene-1,4-(2,5-dihydroxy)phenylene] fibers (PIPD fibers) (e.g., M5® fibers from DuPont of Wilmington, Del.). Suitable fibers made from thermotropic liquid-crystalline polymers include poly(6-hydroxy-2-napthoic acid-co-4-hydroxybenzoic acid) fibers (e.g., VECTRAN® fibers from Celanese of Charlotte, N.C.). Suitable fibers also include carbon fibers, such as those made from the high temperature pyrolysis of rayon, polyacrylonitrile (e.g., OPF® fibers from Dow of Midland, Mich.), and mesomorphic hydrocarbon tar (e.g., THORNEL® fibers from Cytec of Greenville, S.C.). In certain possibly preferred embodiments, the yarns or fibers 113 and 212 comprise fibers selected from the group consisting of gel-spun ultrahigh molecular weight polyethylene fibers, melt-spun polyethylene fibers, melt-spun nylon fibers, melt-spun polyester fibers, sintered polyethylene fibers, aramid fibers, PBO fibers, PBZT fibers, PIPD fibers, poly(6-hydroxy-2-napthoic acid-co-4-hydroxybenzoic acid) fibers, carbon fibers, and combinations thereof. In one particularly preferred embodiment, the spike resistant textile layer 210 comprises aramid fibers 212. In another particularly preferred embodiment, the strike face layer 110 comprises aramid fibers 113.

The strike face layers 110 contain a resin 111 which at least partially covers at least one side of the high tenacity yarns 113. Each layer 110, in one embodiment, is substantially surrounded and substantially impregnated with the corresponding resin 111 comprising a thermoset or thermoplastic resin, or mixtures thereof. A laminate film, which melts and at least partially coats the fibers is an example of the resin. A wide variety of suitable thermoset and thermoplastic resins and mixtures thereof are well known in the prior art and can be used as the matrix material. For example, thermoplastic resins can comprise one or more polyurethane, polyimide, polyethylene, polyester, polyether etherketone, polyamide, polycarbonate, and the like. Thermoset resins can be one or more epoxy-based resin, polyester-based resin, phenolic-based resin, and the like, preferably a polyvinylbutyral phenolic resin. Mixtures can be any combination of the thermoplastic resins and the thermoset resins. The proportion of the resin 11 in each layer 110 is from about 5% to about 50% by weight, preferably about 20% to 30% by weight. For enhanced penetration resistance, the resin 111 should have a tensile strength of at least 10 MPa, and preferably at least 20 MPa, according to ASTM D-638. The flexural modulus of the polymeric matrices, according to ASTM D-790, is preferably at least 50 MPa. While the upper limit for the flexural modulus is not critical, it is preferred that the resin have a flexural modulus of no more than 20,000 MPa so that the layers 110 are not too rigid.

Additional layers may be added to the flexible spike and ballistic resistant panel 10 to add additional spike, knife, and/or ballistic resistance or other desired properties. Examples of suitable known puncture resistant materials or components include, but are not limited to, mail (e.g., chain mail), metal plating, ceramic plating, layers of textile materials made from high tenacity yarns which layers have been impregnated or laminated with an adhesive or resin, or textile materials made from low denier high tenacity yarns in a tight woven form such as DuPont KEVLAR CORRECTIONAL® available from DuPont.

Commercially-available, flexible ballistic resistant panels such as those described above include, but are not limited to, the SPECTRA SHIELD® high-performance ballistic materials sold by Honeywell International Inc. Such ballistic resistant laminates are believed to be more fully described in U.S. Pat. No. 4,916,000 (Li et al.); U.S. Pat. No. 5,437,905 (Park); U.S. Pat. No. 5,443,882 (Park); U.S. Pat. No. 5,443,883 (Park); and U.S. Pat. No. 5,547,536 (Park), each of which is herein incorporated by reference. Other commercially available high performance flexible ballistic resistant materials include DYNEEMA UD® available from DSM Dymeema, and GOLDFLEX® available from Honeywell International Inc. These high performance flexible ballistic materials may be used together with the flexible spike and ballistic resistant panel 10 to enhance overall ballistic performance.

In another embodiment, the strike face grouping and/or the rear face grouping may contain fabric layers formed from monoaxially drawn, thermoplastic fiber elements, wherein the fiber elements are bonded to each other. These thermoplastic fibers may contain polypropylene multi-layered tapes and polypropylene core/shell fibers. The thermoplastic fibers being tape elements are preferred in some embodiments. In another embodiment, the thermoplastic fibers comprise of a base layer and at least one covering layer of a heat fusible polymer wherein the covering layer is characterized by a softening temperature below that of the base layer to permit fusion bonding upon application of heat, wherein the fiber elements within each fabric layer are consolidated to one another by the covering layer. The layers may be adhered to the other layers in the panel or may be freestanding. These tapes, fibers, and their textile layer constructions are believed to be more fully described in U.S. Patent Publication No. 2007/0071960 (Eleazer et al.) which is incorporated by reference.

Such spike and knife resistant materials or components can be attached to adjacent textiles layer using any suitable means, such as an adhesive, stitches, or other suitable mechanical fasteners, or the material or component and textile layers can be disposed adjacent to each other and held in place relative to each other by a suitable enclosure, such as a pocket in a piece of body armor which is adapted to carry a spike, knife, and/or ballistic resistant insert. The flexible spike and ballistic resistant panel 10 according to the invention can further comprise one or more layers of suitable backing material, such as a textile material (e.g., a textile material made from any suitable natural or synthetic fiber), foam, or one or more plastic sheets (e.g., polycarbonate sheets). For example, the backing material can comprise a plurality of layers of woven, non-woven, or knit polyester textile material which are positioned adjacent to the upper or lower surface of the above-described textile layers. The backing material can also be a trauma pack (e.g., one or more polycarbonate sheets), such as those typically used in body armor.

The process to form the spike resistant textile layers 210 where the spike resistant textile layers 210 comprising a plurality of interwoven yarns or fibers having a tenacity of about 5 or more grams per denier, wherein at least one of the surfaces of the spike resistant textile layer comprises about 10 wt. % or less, based on the total weight of the textile layer, of a coating comprising a plurality of particles having a diameter of about 20 μm or less comprises the steps of (a) providing a first textile layer, (b) contacting at least one of the lower surface of the first textile layer with a coating composition comprising a plurality of particles having a diameter of about 20 μm or less, and (c) drying the textile layer treated in step (b) to produce a coating on the lower surface of the first textile layer or the upper surface of the second textile layer.

The surface(s) of the textile layers can be contacted with the coating composition in any suitable manner. The textile layers can be contacted with the coating composition using conventional padding, spraying (wet or dry), foaming, printing, coating, and exhaustion techniques. For example, the textile layers can be contacted with the coating composition using a padding technique in which the textile layer is immersed in the coating composition and then passed through a pair of nip rollers to remove any excess liquid. In such an embodiment, the nip rollers can be set at any suitable pressure, for example, at a pressure of about 280 kPa (40 psi). Alternatively, the surface of the textile layer to be coated can be first coated with a suitable adhesive, and then the particles can be applied to the adhesive.

The coated textile layers can be dried using any suitable technique at any suitable temperature. For example, the textile layers can be dried on a conventional tenter frame or range at a temperature of about 160° C. (320° F.) for approximately five minutes. The formed spike resistant textile layer comprises about 10 wt. % or less, based on the total weight of the textile layer, of a coating comprising a plurality of particles having a diameter of about 20 μm or less may be found in US Patent Publication 2007/0105471 (Wang et al.), incorporated herein by reference.

The layers 210 and 110 can be disposed adjacent to each other and held in place relative to each other by a suitable enclosure, such as a pocket or can be attached to each other by any known fastening means. In certain possibly preferred embodiments the layers 110 and 210 can also be sewn together in a desired pattern, for example, around the corners or along the perimeter of the stacked textile layers in order to secure the layers in the proper or desired arrangement. Additionally, the layers 210 and 110 may be adhered together using a patterned adhesive or other fastening means such as rivets, bolts, wires, or clamps.

EXAMPLES

Various embodiments of the invention are shown by way of the Examples below, but the scope of the invention is not limited by the specific Examples provided herein.

Test Methods

Layer Stiffness Test Method

The stiffness of the layer, groupings, and panels were measured according to the modified ASTM Test Method D6828-02, entitled "Standard Test Method for Stiffness of Fabric by Blade/Slot Procedure". The sample size used was 1 inch by 4 inch and the width of the slot was set to 20 mm. For nonsymmetrical configurations, the stiffness value listed is an average of the stiffness measurements in all orientations.

Spike Resistance Test Method

The panels of the examples were encased in a nylon bag and then tested for spike stab resistance according to NIJ Standard 0115.00 (2000), entitled "Stab Resistance of Personal Body Armor". The stab energy of the drop mass was set at 65 J (Protection Level III at "E2" overtest strike energy) and at 43J (Protection level III at "E1" strike energy) and at 0 degree incidence. "Passing" is defined to be a penetration of less than 7 mm for "E1" strike energy and 20 mm for "E2" overtest strike energy. The NIJ engineered spike were used as the threat weapon.

Ballistic Test Method

The panels of the examples were encased in a nylon bag and then tested for ballistic resistance according to NIJ Standard 0101.04 (2000), entitled "Ballistic Resistance of Personal Body Armor". The samples were tested for Type II body armor.

Layer Materials

"A" Layer

A KEVLAR® fabric HEXCEL STYLE 310® available from Hexcel Corporation located in Anderson, S.C., was obtained. The Kevlar fabric (Hexcel Style 310) was comprised of KEVLAR COMFORT 400 denier warp and fill yarns woven together in a plain weave construction with 36 ends/inch and 36 picks/inch. It is believed that the KEVLAR COMFORT fiber has similar tensile and modulus properties as KEVLAR 129® fiber. The fabric layer weighed 3.6 oz/yd$^2$. A spike resistant layer was prepared by coating the KEVLAR® fabric in a bath comprising:

a) approximately 200 grams (or 20%) of CAB-O-SPERSE PG003®, a fumed alumina dispersion (40% solids) with 150 nm particle size available from Cabot Corporation, b) 20 grams (or 2%) MILLITEX RESIN MRX®, a blocked isocyanate based cross-linking agent (35-45% by wt. solids) available from Milliken Chemical, and c) approximately 780 grams of water The solution was applied using a padding process (dip and squeeze at a roll pressure of 40 psi). The fabric was then dried at 320° F. The dry weight add-on of the chemical on the fabric was approximately 3%. The coated fabric layer will be designated as the "A" layer in the following examples.

"B" Layer

A KEVLAR® fabric HEXCEL STYLE 726® available from Hexcel Corporation located in Anderson, S.C., was obtained. The Kevlar fabric (Hexcel Style 726) was comprised of KEVLAR 129® 840 denier warp and fill yarns woven together in a plain weave construction with 27 ends/inch and 27 picks/inch. The KEVLAR 129® fiber has a tensile strength of approximately 27 grams per denier (g/d) and an initial tensile modulus of approximately 755 g/d. The fabric layer weighed 5.9 oz/yd$^2$. A spike resistant layer was prepared by coating the KEVLAR® fabric in a bath comprising:

a) approximately 200 grams (or 20%) of CAB-O-SPERSE PG003®, a fumed alumina dispersion (40% solids) with 150 nm particle size available from Cabot Corporation, b) 20 grams (or 2%) MILLITEX RESIN MRX®, a blocked isocyanate based cross-linking agent (35-45% by wt. solids) available from Milliken Chemical, and c) approximately 780 grams of water The solution was applied using a padding process (dip and squeeze at a roll pressure of 40 psi). The fabric was then dried at 320° F. The dry weight add-on of the chemical on the fabric was approximately 3%. The coated fabric layer will be designated as the "B" layer in the following examples.

"C" Layer

A resinated aramid fabric layer Parax® 155 available from Pro-Systems was obtained. The fabric layer weighed 6.3 oz/yd$^2$. The aramid fibers were in a plain weave construction with 529 denier warp and fill yarns woven together with 33.5 ends/inch and 33.5 picks/inch. The aramid fibers were approximately 74% by weight of the fabric layer.

"D" Layer

A KEVLAR® fabric HEXCEL STYLE 310® available from Hexcel Corporation located in Anderson, S.C., was obtained. The Kevlar fabric (Hexcel Style 310) was comprised of KEVLAR COMFORT 400 denier warp and fill yarns woven together in a plain weave construction with 36 ends/inch and 36 picks/inch. It is believed that the KEVLAR COMFORT fiber has similar tensile and modulus properties as KEVLAR 129® fiber. The fabric layer weighed 3.6 oz/yd$^2$. The "D" Layer is similar to the "A" layer, except that the "D" Layer has no coating.

"E" Layer

A KEVLAR® fabric HEXCEL STYLE 726® available from Hexcel Corporation located in Anderson, S.C., was obtained. The Kevlar fabric (Hexcel Style 726) was comprised of KEVLAR 129® 840 denier warp and fill yarns woven together in a plain weave construction with 27 ends/inch and 27 picks/inch. The KEVLAR 129® fiber has a tensile strength of approximately 27 grams per denier (g/d) and an initial tensile modulus of approximately 755 g/d. The fabric layer weighed 5.9 oz/yd$^2$. The "E" Layer is similar to the "B" layer, except that the "E" Layer has no coating.

"F" Layer

A resinated aramid fabric layer Protexa® available from Versaideg was obtained. The fabric layer weighed 9.4 oz/yd$^2$. The aramid fibers were in a plain weave construction.

Examples

For each of the examples, the summary for the orientation of the Examples are shown in Table 1. The stiffness and normalized stiffness with respect to its areal density for the Examples are shown in Table 2. The assembly was tested for ballistic and spike stab resistance. The results of the spike testing are shown in Table 3 and the ballistics testing results are shown in Table 4.

Example 1

Example 1 was formed from arranging the following layers in order: 36 "A" layers and 3 "C" layers with the grouping of "A" layers oriented as the strike face surface. The example had an areal density of 5.17 kg/m$^2$ and was encased in a nylon bag for testing.

Example 2

Example 2 was formed from arranging the following layers in order: 18 "A" layers, 3 "C" layers, and 18 "A" layers with the one of the groupings of "A" layers oriented as the strike face surface. The example had an areal density of 5.17 kg/m$^2$ and was encased in a nylon bag for testing.

Example 3

Example 3 was formed from arranging the following layers in order: 3 "C" layers and 36 "A" layers with the grouping of "C" layers oriented as the strike face surface. The example had an areal density of 5.17 kg/m$^2$ and was encased in a nylon bag for testing.

Example 4

Example 4 was formed from arranging the following layers in order: 14 "A" layers, 14 "B" layers, and 3 "C" layers with the grouping of "A" layers oriented as the strike face surface. The example had an areal density of 5.22 kg/m$^2$ and was encased in a nylon bag for testing.

Example 5

Example 5 was formed from arranging the following layers in order: 14 "A" layers, 3 "C" layers, and 14 "B" layers with the grouping of "A" layers oriented as the strike face surface. The example had an areal density of 5.22 kg/m$^2$ and was encased in a nylon bag for testing.

Example 6

Example 6 was formed from arranging the following layers in order: 3 "C" layers, 14 "A" layers, and 14 "B" layers with the grouping of "C" layers oriented as the strike face surface. The example had an areal density of 5.22 kg/m$^2$ and was encased in a nylon bag for testing.

Example 7

Example 7 was formed from arranging the following layers in order: 3 "C" layers and 37 "D" layers with the grouping of "C" layers oriented as the strike face surface. The example had an areal density of 5.16 kg/m$^2$ and was encased in a nylon bag for testing.

Example 8

Example 8 was formed from arranging the following layers in order: 3 "C" layers, 15 "D" layers, and 14 "E" layers with the grouping of "C" layers oriented as the strike face surface. The example had an areal density of 5.28 kg/m$^2$ and was encased in a nylon bag for testing.

Example 9

Example 9 was formed from arranging the following layers in order: 3 "F" layers and 36 "A" layers with the grouping of "F" layers oriented as the strike face surface. The example had an areal density of 5.46 kg/m$^2$ and was encased in a nylon bag for testing.

TABLE 1

Summary of Examples Orientation (listed from strike face to rear)

| Example | Layer Summary |
|---|---|
| 1 | 36A/3C |
| 2 | 18A/3C/18A |
| 3 | 3C/36A |
| 4 | 14A/14B/3C |
| 5 | 14A/3C/14B |
| 6 | 3C/14A/14B |
| 7 | 3C/37D |
| 8 | 3C/15D/14E |
| 9 | 3F/36A |

Discussion of Results

The following table shows the stiffness and normalized stiffness (to areal density) for each of the Layers tested according to the Layer Stiffness Test Method described above.

TABLE 1

Stiffness and normalized stiffness of Example Layers

| Layer | Stiffness (g) | Normalized Stiffness (g/g/m$^2$) |
|---|---|---|
| A | 4.5 | 0.035 |
| B | 18 | 0.087 |
| C | 215 | 1.00 |
| D | 186.5 | 0.58 |

TABLE 2

Spike Penetration test for Examples

| Example | Areal Density (kg/m$^2$) | Spike Penetration at 43J (mm) | Spike Penetration at 65J (mm) |
|---|---|---|---|
| 1 | 5.17 | 9 | 12 |
| 2 | 5.17 | Not tested | 32 |
| 3 | 5.17 | 0 | 0 |
| 4 | 5.27 | 11 | 15 |
| 5 | 5.22 | Not tested | 34 |
| 6 | 5.22 | 0 | 0 |
| 7 | 5.16 | Full penetration | Full penetration |
| 8 | 5.28 | Full penetration | Full penetration |
| 9 | 5.46 | 0 | 0 |

Examples 3, 6, and 9 embody the invention where the panel contains at least 2 strike face layers having at least 50% wt high tenacity yarns and at least 10 layers of spike resistant woven textile layers, each textile layer comprising a plurality of interwoven yarns or fibers having a tenacity of about 5 or more grams per denier, wherein at least one of the surfaces of the spike resistant textile layer comprises about 10 wt. % or less, based on the total weight of the textile layer, of a coating comprising a plurality of particles having a diameter of about 20 μm or less and wherein the normalized stiffness of each strike face layer is about 3 to 50 times greater than the normalized stiffness of each textile layer. Each of Examples 3, 6, and 9 clearly demonstrate flexible panels that pass level 3 spike resistance and level 2 ballistics resistance.

As one can see from comparing Examples 1 and 3, having the higher normalized stiffness layers "C" as the strike face verses the rear layers increases the spike resistance significantly (12 mm versus 0 mm penetration). The same results can be seen by comparing Examples 4 and 6 using "A" and "B" layers with the "C" layers. Additionally, having the higher stiffness layers "C" as the strike face provides better protection from spike penetration than having the "C" layers within the "A" layers or within the "A" and "B" layers.

Examples 7 and 8 show that replacing the spike resistant woven textile layers of the invention with the same construction of aramid fibers without the particle coating, the samples completely failed the spike test with the spike penetrating through the entire 65 mm sample.

Examples 1 and 3 were subjected to ballistics testing for NIJ level II. Because the examples passed the 9 mm FMJ test easily, 0.357 magnum bullets were used to compare the ballistic performance of the examples. The BFS (back face signature) of the samples were 27 mm for Example 1, 35 mm for Example 3. Comparing Examples 1 and 3 illustrates that the orientation of the "C" layers in front of the "A" layers produces a flexible panel that meets the ballistics requirements just as Example 1, but has far superior spike resistance.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A flexible spike and ballistics panel having a strike surface and a rear surface, wherein the panel comprises:

a strike face grouping comprising at least two strike face layers, each strike face layer comprising resin and high tenacity yarns, wherein the high tenacity yarns are in an amount of at least 50% by weight in each layer, wherein the high tenacity yarns have a tenacity of at least 5 grams per denier, and wherein the strike face grouping forms the strike surface of the panel; and, a rear face grouping comprising at least ten spike resistant textile layer, each textile layer comprising a plurality of interwoven yarns or fibers having a tenacity of about 5 or more grams per denier, wherein at least one of the surfaces of the spike resistant textile layer comprises about 10 wt. % or less, based on the total weight of the textile layer, of a coating comprising a plurality of particles having a diameter of about 20 μm or less, wherein the normalized stiffness of each strike face layer is about 3 to 50 times greater than the normalized stiffness of each textile layer.

2. The flexible spike and ballistics panel of claim 1, wherein the strike face grouping comprises at least 3 strike face layers.

3. The flexible spike and ballistics panel of claim 1, wherein the rear face grouping comprises at least 20 spike resistant textile layers.

4. The flexible spike and ballistics panel of claim 1, wherein the normalized stiffness of each strike face layer is about 5 to 30 times greater than the normalized stiffness of each textile layer.

5. The flexible spike and ballistics panel of claim 1, wherein the high tenacity yarns of the strike face layers comprise aramid fibers.

6. The flexible spike and ballistics panel of claim 1, wherein the panel comprises less than about 20% by weight strike face layers and greater than about 80% by weight spike resistant textile layers.

7. The flexible spike and ballistics panel of claim 1, wherein the panel comprises less than about 15% by weight strike face layers and greater than about 85% by weight spike resistant textile layers.

8. The flexible spike and ballistics panel of claim 1, wherein the particles are selected from the group consisting of silica, alumina, silicon carbide, titanium carbide, tungsten carbide, titanium nitride, silicon nitride, and combinations thereof.

9. The flexible spike and ballistics panel of claim 8, wherein the particles are selected from the group consisting of fumed alumina and fumed silica.

10. The flexible spike and ballistics panel of claim 1, wherein the particles have a diameter of about 300 nm or less.

11. The flexible spike and ballistics panel of claim 1, wherein the yarns or fibers of the spike resistant textile layers comprise fibers selected from the group consisting of gel-spun ultrahigh molecular weight polyethylene fibers, melt-spun polyethylene fibers, melt-spun nylon fibers, melt-spun polyester fibers, sintered polyethylene fibers, aramid fibers, PBO fibers, PBZT fibers, PIPD fibers, poly(6-hydroxy-2-napthoic acid-co-4-hydroxybenzoic acid) fibers, carbon fibers, and combinations thereof.

12. The flexible spike and ballistics panel of claim 1, wherein the yarns or fibers of the spike resistant textile layers comprise aramid fibers.

13. The flexible spike and ballistics panel of claim 1, wherein the yarns or fibers of the spike resistant textile layers have a tenacity of about 14 or more grams per denier.

14. The flexible spike and ballistics panel of claim 1, wherein the coating comprises about 5 wt. % or less of the total weight of the textile layer.

15. The flexible spike and ballistics panel of claim 1, wherein both the spike resistant textile layers and the strike face layers are in a woven construction.

16. The flexible spike and ballistics panel of claim 1, wherein the strike face grouping further comprises fabric layers formed from monoaxially drawn, thermoplastic fiber elements, wherein the fiber elements are bonded to each other within the fabric layer.

17. The flexible spike and ballistics panel of claim 16, wherein the thermoplastic fibers comprise of a base layer and at least one covering layer of a heat fusible polymer wherein the covering layer is characterized by a softening temperature below that of the base layer to permit fusion bonding upon application of heat, wherein the fiber elements within each fabric layer are consolidated to one another by the covering layer.

18. The flexible spike and ballistics panel of claim 16, wherein the thermoplastic fibers are tape elements.

* * * * *